US007458538B2

(12) United States Patent
Betti et al.

(10) Patent No.: US 7,458,538 B2
(45) Date of Patent: Dec. 2, 2008

(54) UNWINDING DEVICE FOR REELS OF WEB MATERIAL WITH DUAL DRIVE MECHANISM AND RELATIVE UNWINDING METHOD

(75) Inventors: Giulio Betti, Lucca (IT); Roberto Morelli, Lucca (IT); Angelo Benvenuti, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 603 days.

(21) Appl. No.: 10/534,914

(22) PCT Filed: Nov. 13, 2002

(86) PCT No.: PCT/IT02/00721

§ 371 (c)(1),
(2), (4) Date: May 13, 2005

(87) PCT Pub. No.: WO2004/043837

PCT Pub. Date: May 27, 2004

(65) Prior Publication Data

US 2006/0038051 A1 Feb. 23, 2006

(51) Int. Cl.
*B65H 23/06* (2006.01)

(52) U.S. Cl. ..... 242/420.1; 242/420.2; 242/420.3; 242/420.4; 242/420.5; 242/420.6

(58) Field of Classification Search .... 242/420.1–420.6
See application file for complete search history.

(56) References Cited

U.S. PATENT DOCUMENTS

| | | | | |
|---|---|---|---|---|
| 2,892,597 | A | 6/1959 | Schmidt | |
| 2,984,429 | A | 5/1961 | Huck | |
| 3,202,376 | A | 8/1965 | Dutro et al. | |
| 3,740,296 | A | 6/1973 | McDonald | |
| 4,278,213 | A * | 7/1981 | Rubruck | 242/420.2 |
| 4,729,522 | A * | 3/1988 | Tafel et al. | 242/418.1 |
| 4,883,233 | A | 11/1989 | Saukkonen et al. | |
| 4,893,763 | A * | 1/1990 | Wales et al. | 242/420.3 |
| 5,000,394 | A * | 3/1991 | Wales et al. | 242/420.3 |
| 5,156,350 | A * | 10/1992 | Wales et al. | 242/420.3 |
| 5,344,089 | A * | 9/1994 | Crowley et al. | 242/417 |
| 5,472,153 | A | 12/1995 | Crowley et al. | |
| 5,651,511 | A * | 7/1997 | Crowley et al. | 242/420.3 |
| 5,906,333 | A | 5/1999 | Fortuna et al. | |
| 6,030,496 | A | 2/2000 | Baggot et al. | |

FOREIGN PATENT DOCUMENTS

| | | |
|---|---|---|
| EP | 0 321 887 A2 | 6/1989 |
| EP | 1 136 406 A2 | 9/2001 |
| GB | 0 321 887 A2 | 4/1958 |
| GB | 2161146 A * | 1/1986 |

(Continued)

*Primary Examiner*—Sang Kim
(74) *Attorney, Agent, or Firm*—Breiner & Breiner, LLC

(57) ABSTRACT

The device comprises: supports (3A, 5A; 3B, 5B) to support at least a reel (B1) in an unwinding position; at least a peripheral drive mechanism which acts on the cylindrical surface of the reel being unwound and transmits peripherally to said reel a torque to draw it in rotation; and at least a center drive mechanism (41) which transmits centrally to said reel an auxiliary torque to draw it in rotation together with the torque transmitted by the peripheral drive mechanism.

22 Claims, 3 Drawing Sheets

FOREIGN PATENT DOCUMENTS

| | | | |
|---|---|---|---|
| WO | WO 95/34497 | A1 | 12/1995 |
| WO | WO 96/33120 | A1 | 10/1996 |
| WO | 0 872 440 | A2 | 10/1998 |
| WO | WO 98/46509 | A1 | 10/1998 |
| WO | WO 01/64562 | A2 | 9/2001 |
| WO | WO 01/64562 | A3 | 9/2001 |

* cited by examiner

UNWINDING DEVICE FOR REELS OF WEB MATERIAL WITH DUAL DRIVE MECHANISM AND RELATIVE UNWINDING METHOD

TECHNICAL FIELD

The present invention relates to an unwinding device to unwind reels or rolls of web material and feed the web material to subsequent stations of a converting line or similar. More particularly, although not exclusively, the present invention relates to a device of the aforesaid type for unwinding reels of paper material, such as tissue paper to produce toilet paper, kitchen towels or similar, or napkins, handkerchiefs or other products.

The present invention also relates to a method for unwinding a web material from a reel and delivering it to a converting line downstream.

STATE OF THE ART

In many industrial fields, in particular in the paper converting field, it is necessary to deliver a web material, for example a sheet of paper, from a starting reel or roll to a converting line in which the web material is manipulated to produce semi-finished or finished products. For example, to produce paper in rolls, such as toilet or kitchen paper, large reels are placed in unwinding devices from which the web material from one or more reels is delivered to a converting line to produce rolls, which are subsequently cut into small rolls destined to be packaged and marketed. Analogously, reels of paper web material are used to feed lines to produce napkins, paper handkerchiefs or the like. Unwinding devices of parent reels with large diameters are also used in the plastic films and non-woven processing sector to feed the web product wound on the reels towards processing means downstream.

Above all in the paper converting sector, the unwinding devices have motor-driven unwinding mechanisms, typically composed of motor-driven belts, which transmit a torque to the reel being unwound as a result of friction between the drive mechanism and the external surface of the reel. These are referred to as unwinding devices with peripheral operation, indicating that the torque required to make the reel rotate and hence deliver the web material is transmitted by friction through the external surface, that is the periphery, of the reel. Examples of unwinding devices of this type are described in GB-A-0793937; U.S. Pat. No. 3,740,296; EP-A-0321887; U.S. Pat. No. 4,883,233; U.S. Pat. No. 3,202,376; U.S. Pat. No. 2,984,429; WO-A-9534497; WO-A-9633120.

In certain particular situations, such as when the reel of web material is exceptionally large in size and/or has a limited winding density, peripheral drawing is not suitable, as it may cause phenomena of reciprocal slippage between the turns of material wound on the reel (especially in the central zone of the reel), as a result of poor adhesion of the turns of web material and/or of the high inertia of the reel and its central shaft. Difficulties in unwinding occur in particular when the dimensions of the reel are considerable and the web material wound is particularly soft and delicate, such that when it is wound on the reel it cannot be tightened and the reel thus has a low winding density.

To prevent reciprocal slippage between the turns of web material in these circumstances it would be necessary to exert high pressure on the reel with the peripheral unwinding mechanisms. This is not advisable as it would cause permanent deformation of the web material with loss of those properties of softness and bulk obtained during production of the material using special procedures.

To solve these problems unwinding devices which apply an unwinding torque to the reel through the central shaft of the reel have been studied. Examples of unwinding devices of this type are described in U.S. Pat. No. 5,906,333; U.S. Pat. No. 6,030,496; EP-A-0872440 and WO-A-9846509.

EP-A-1136406 describes a dual unwinding device with a structure known per se and substantially equivalent to the one described in WO-A-95344497, in which unwinding is obtained by means of a center drive mechanism of the type equivalent to the one described for example in WO-A-9846509.

These systems with central operation are not satisfactory, especially when the reel has a large diameter and high inertia. Moreover, in some cases each side of the reel is provided with a mechanism in the form of a rotating plate, which presses on the flat surface to transmit rotational motion. This mechanism has a diameter which may be greater than the diameter of the reel being wound, especially when the diameter of the reel decreases as a result of delivery of the material. When this occurs the web material often breaks due to the fact that the edge of the outermost turn of the material is pinched and withheld between the flat frontal surface of the reel and the relative rotating plate mechanism. When this occurs the web material is prevented from unwinding and the material tears.

OBJECTS AND SUMMARY OF THE INVENTION

The object of the present invention is to produce an unwinding device for unwinding reels of web material which may efficiently also manipulate reels with large diameters and/or reels with very little winding density and/or of soft and delicate material and which is particularly suitable for manipulating reels of tissue paper.

Another object of the present invention is to produce an unwinding device which can unwind reels of web material without the risk of reciprocal slippage between the, turns of web material and of damage to the material.

These and other objects and advantages which shall become apparent to those skilled in the art by reading the text below are attained in substance with an unwinding device comprising:

- supports for supporting at least a reel in an unwinding position;
- at least a peripheral drive mechanism which acts on the cylindrical surface of the reel being unwound and peripherally transmits to said reel a torque to draw it in rotation;
- at least a center drive mechanism which transmits an auxiliary torque to the center of said reel to draw it in rotation in combination with the torque transmitted by said peripheral drive mechanism;
- a control system for reciprocally coordinating the operation of said peripheral drive mechanism and of said center drive mechanism.

In substance, in the device according to the invention the overall torque applied to the reel to cause rotation and consequently unwinding of the web material is in part exerted peripherally, through the peripheral drive mechanism, and in part centrally, through the shaft of the reel, through the center drive mechanism. Control of the torque applied to the two drive mechanisms, so that these are balanced, i.e. suitably distributed, guarantees correct unwinding, without reciprocal slippage between the turns of the reel.

As well as the advantage of obtaining regular unwinding without the risk of wrinkling the web material and/or of slippage between the turns of the material wound on the reel, with the device according to the invention it is also possible to attain rapid accelerations of the reel even when this has high inertia. In this way it is possible to reach the operating speed very quickly each time it is necessary to replace a reel that is used up or damaged with a new reel, which usually requires the production line to be stopped.

The fact that the new reel can be rapidly accelerated to the regular operating speed makes it possible to reduce downtimes and increase the average production level of the production line.

The presence of a dual drive mechanism also makes it possible to attain the further advantage of adopting a variable unwinding mode according to the nature of the web material and the characteristics of the reels being unwound. Indeed, the control system may be also programmed to control the central and peripheral drive mechanisms so as to deactivate one of the two. If the nature of the material and the characteristics of the reel advise purely peripheral unwinding, it is possible through the control system to deactivate the center drive mechanism. On the other hand, if the characteristics of the material and the reel advise central unwinding, the control system can deactivate the peripheral drive mechanism.

In practice, it is advantageous for the center drive mechanism to be subordinate to the peripheral drive mechanism, in the sense that the operating conditions of the center drive mechanism are varied by means of a feedback signal maintaining the unwinding conditions of the reel under control. On the other hand, the peripheral drive mechanism is controlled in the usual way, to maintain constant or substantially constant the tension of the web material delivered to the converting-line downstream of the unwinding device.

In a possible embodiment the center drive mechanism or in any case of the subordinate drive mechanism is controlled by controlling the torque applied. In substance, in this case the control modifies the operating conditions of the drive mechanism so that the torque that it applies to the reel is maintained substantially constant or in any case within a range or interval of predefined values. These predefined values may in actual fact be a function of the torque applied by the other drive mechanism. For example, the overall torque applied may be equally distributed between the two drive mechanisms. In this case, the value applied by the center drive mechanism is not maintained at a fixed absolute value or within an interval defined by fixed absolute value, but at a value or within an interval of values defined time by time as a function of the operating conditions, that is of the total torque required to maintain the reel in rotation.

According to another embodiment of the invention, control is implemented by detecting any slippage of the web material. For this purpose the web material may be provided with a reference which is read by a specific sensor. A second reference applied to the shaft of the reel, or in any case in a fixed angular position in relation to the shaft is detected by a second sensor. The angular distance between the two references must remain the same. When there are variations in this angular distance this means that the web material tends to slip on the reel. This condition must be avoided and the operating conditions of the subordinate drive mechanism (particularly of the center drive mechanism) are controlled and modified by means of a feedback signal proportional to this possible slippage or sliding of the web material, i.e. on the basis of a signal which detects (preferably with each turn of the reel and in any case repeatedly during unwinding) a variation in the angular distance between the two references.

According to an improvement of the present invention, the unwinding device may be equipped with a sensor to read the external diameter of the reel. The sensor may be a laser sensor, an ultrasound transducer or another suitable sensor. Determination of the diameter may be performed as an average, for example based on a plurality of readings taken during one turn of the reel. This makes it possible to obtain an average value when the reel is ovalized or in any case deformed and not perfectly cylindrical.

The diameter thus detected may allow more accurate control of the device. In fact, when it is necessary to make the reel rotate, for example after replacing a used up reel, the peripheral speed to which the reel must be taken, and with which acceleration law, are known from the operating data of the control unit. This makes it possible to control the peripheral drive mechanism, the speed of which will be equal to the speed requested for the web material unwound from the reel. Nonetheless, the speed at which the center drive mechanism must rotate is not known a priori. By knowing the diameter of the reel it is possible to determine (from the diameter and from the peripheral speed, i.e. from the feed speed of the web material) the angular speed which the reel must have. This angular speed value is used to control the center drive mechanism.

If the diameter is read continually during unwinding, the value of the diameter and the feed speed requested for the web material (equal to the peripheral speed of the reel and therefore of the peripheral drive mechanism) make it possible to calculate moment by moment the theoretical speed of the center drive mechanism. The aforesaid feedback signal overrides the control signal based on the theoretical speed. In this way extremely accurate regulation and control of unwinding is obtained. If the motion of the center drive mechanism determined by the calculated value of angular speed is not sufficient to prevent slippage of the web material, or causes unbalance of the two torques applied by the two drive mechanisms, the feedback signal corrects the operating conditions of the center drive mechanism, acting on one of its operating parameters, for example the torque or the speed.

Further advantageous features and embodiments of the invention are indicated in the attached dependent claims.

The invention also relates to a method for unwinding a reel of web material and delivering said web material to a converting line, in which a first unwinding torque is applied peripherally to said reel through contact means with the cylindrical surface of the reel and in which a second unwinding torque is applied to the shaft of said reel and in which said first and said second unwinding torque are coordinated with each other to correctly unwind the web material from the reel.

In a possible embodiment of the invention, the method includes: placing a peripheral drive mechanism in contact with the cylindrical surface of the reel and applying the first unwinding torque through said peripheral drive mechanism; placing a center drive mechanism in connection with the shaft of the reel and applying said second unwinding torque through said center drive mechanism.

In practice, in a possible embodiment of the invention, the method comprises the phases of:

- detecting during rotation of said reel at least a first reference integral with the central shaft of said reel;
- detecting during rotation of said reel at least a second reference applied to the web-material wound on said reel;
- detecting a possible variation in the angular distance between said first and said second reference and producing a feedback signal as a function of said variation;
- producing a feedback signal as a function of said variation;

modifying an operating parameter of said center drive mechanism as a function of said feedback signal.

In an improved embodiment, the method of the present invention may include the phases of:

operating said peripheral drive mechanism at a peripheral speed;

detecting the diameter of the reel;

calculating an angular speed from said peripheral speed and said diameter;

commanding the center drive mechanism at said angular speed and checking that the central motor performs the command received, with control of reciprocal slippage of the turns of web material or of the torque.

A feedback signal may also be produced to control said center drive mechanism, said feedback signal modifying the operating conditions of the center drive mechanism as a function of the unwinding conditions of the reel.

Further advantageous features and embodiments of the method according to the invention are indicated in the attached dependent claims.

BRIEF DESCRIPTION OF THE DRAWINGS

The invention shall now be better explained with reference to the description and the attached drawing, which shows a practical non-limiting example of the invention. In the drawing.

DETAILED DESCRIPTION OF THE PREFERRED EMBODIMENT OF THE INVENTION

The invention is described below applied to an unwinding device comprising a dual carriage for simultaneously supporting two reels, one of which in stand-by and the other being unwound. This type of unwinding device is used to change the used up reel in automatic mode. It must however be understood that the underlying principles of the invention may also be applied to an unwinding device of another type.

Figure 1:
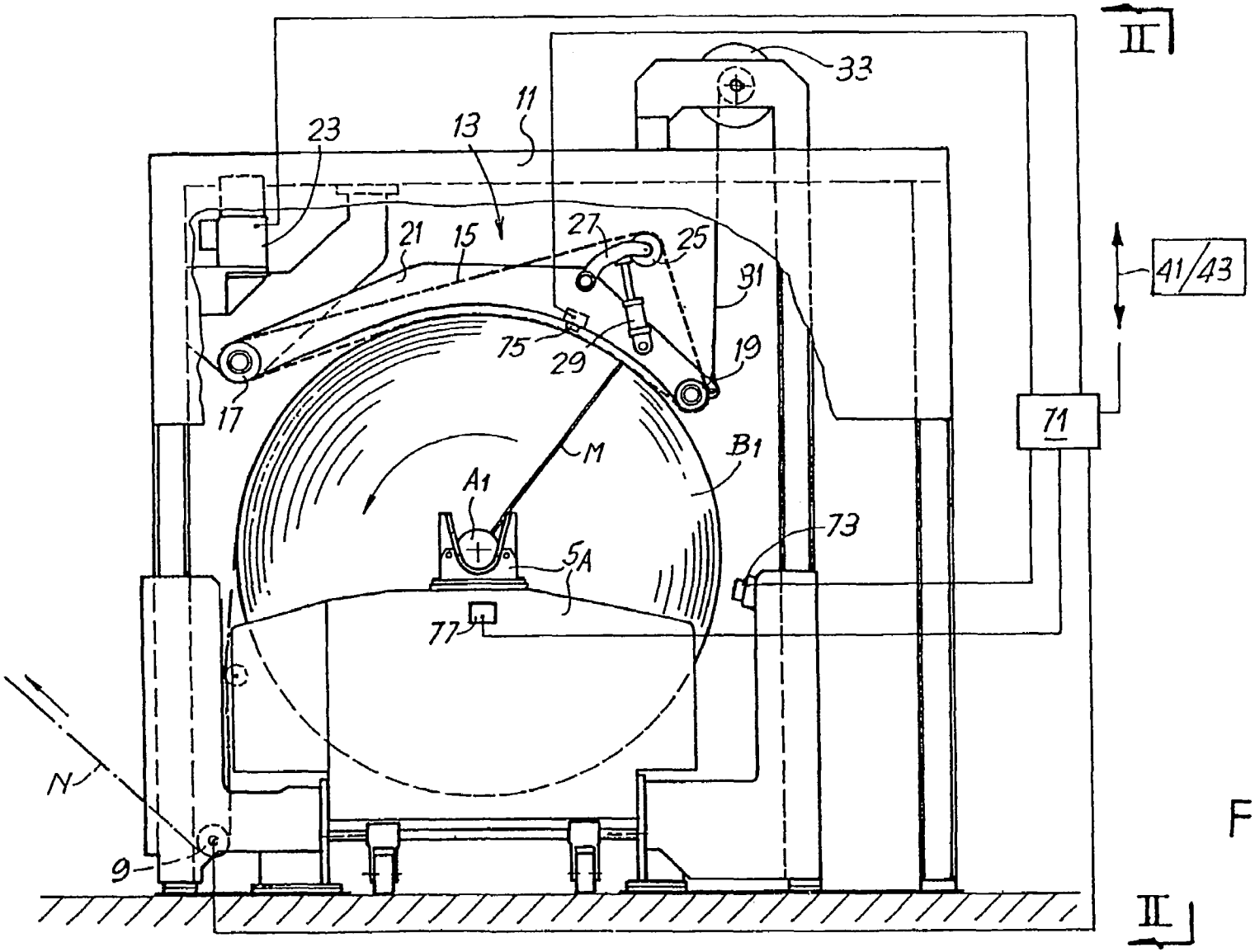
FIG. 1 shows a side view, according to the line I-I of FIG. 2, of an unwinding device incorporating the present invention.
Figure 2:
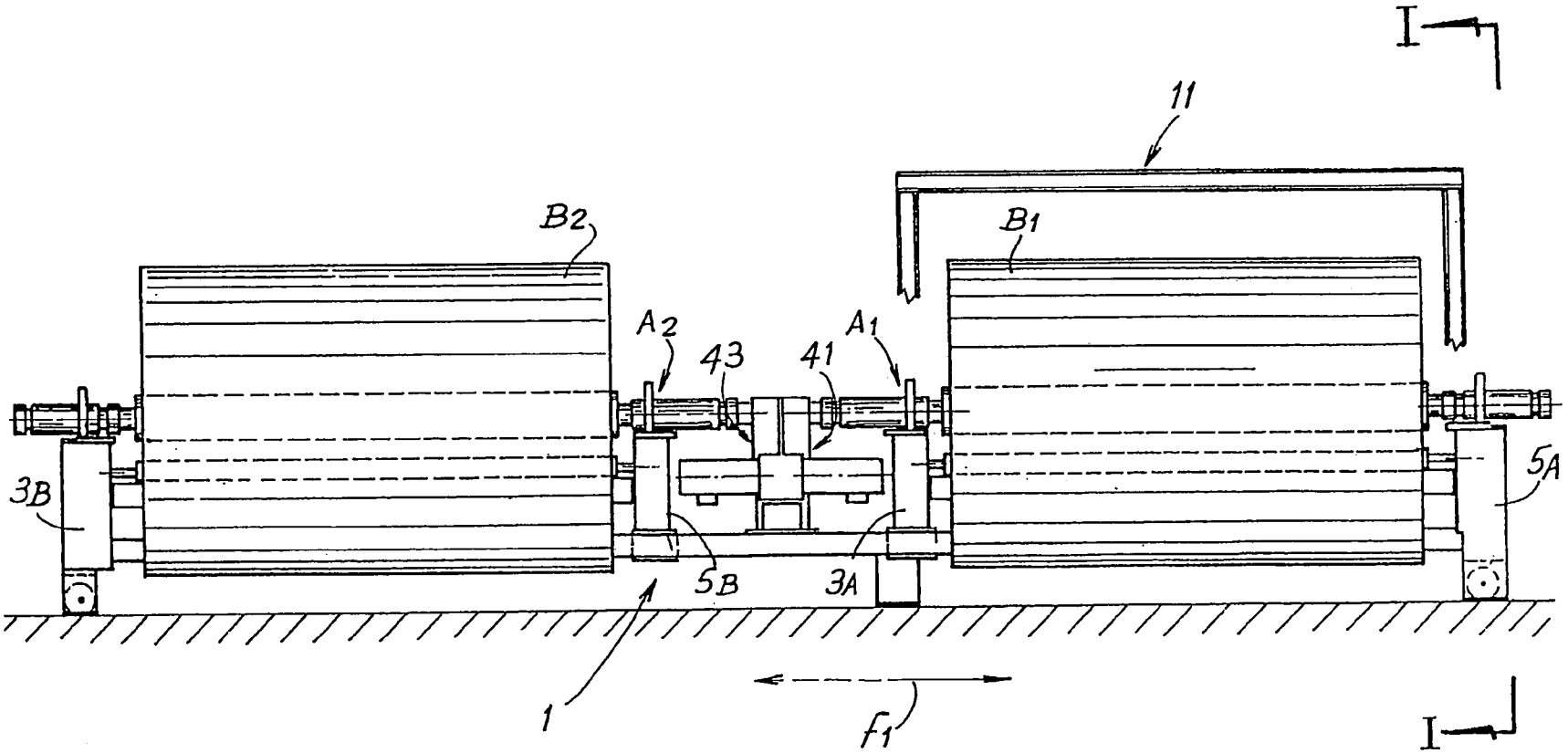
FIG. 2 shows a front view according to II-II in FIG. 1.

The overall structure of the unwinding device incorporating the present invention is shown in FIGS. 1 and 2. In this embodiment the unwinding device comprises a dual carriage 1 that moves according to the double arrow f1 (FIG. 2), provided with two pairs of side supports 3A, 5A and 3B, 5B to simultaneously support two reels B1 and B2. Each of the two reels B1, B2 is wound on a central shaft or core, indicated with A1 and A2 for the two reels B1 and B2 respectively.

The reel B1 is in an unwinding position, corresponding to a processing line to which the web material N unwound from the reel is fed. The reel B2 is in a side standby position to replace the reel B1 when it is used up. Replacement is performed for example as described in WO-A-9534497, the description of which should be referred to for greater details.

In the unwinding position (reel B1), shown in particular in FIG. 1, the web material N is entrained around a cylinder 9 towards subsequent stations where it is subjected to the transformations required to obtain the requested semi-finished or finished products, for example logs of tissue paper. In this position a fixed structure 11 (only schematically shown in FIG. 2) is provided to support a peripheral drive mechanism, generically indicated with 13, which applies a force and consequently an unwinding torque to the cylindrical surface of the reel to make the reel rotate around its axis. In the example shown the peripheral drive mechanism 13 is composed of a plurality of belts parallel with one another, only one of which is visible in FIG. 1 and indicated therein with 15. Each belt 15 is entrained around two pulleys 17, 19 supported on fixes axes in relation to an arm 21 oscillating around the axis of the pulley 17 in relation to the structure 11 which supports the arm. It must be understood that in practice several parallel arms 21 may be provided to support the various unwinding belts 15. The pulley 17 is driven by a motor indicated schematically with 23, so as to make the belt 15 rotate. This is also entrained around a third pulley 25 supported by a small arm 27 hinged to the arm 21 and associated with a piston-cylinder actuator 29. The arm 21 is suspended by means of a cable 31 wound around an overhead winch 33. The layout described above is per se known and the operating method of this drive mechanism is also known. In brief, as the diameter of the reel B1 decreases as a result of delivery of the web material, the small arm 27 rotates counter-clockwise to maintain the tension of the belt 15, until reaching an end position of the actuator 29. At this point the winch 33 causes the arm 21 to lower by unwinding a stretch of cable 31 and thus also causing repositioning of the small arm 27.

Figure 3:
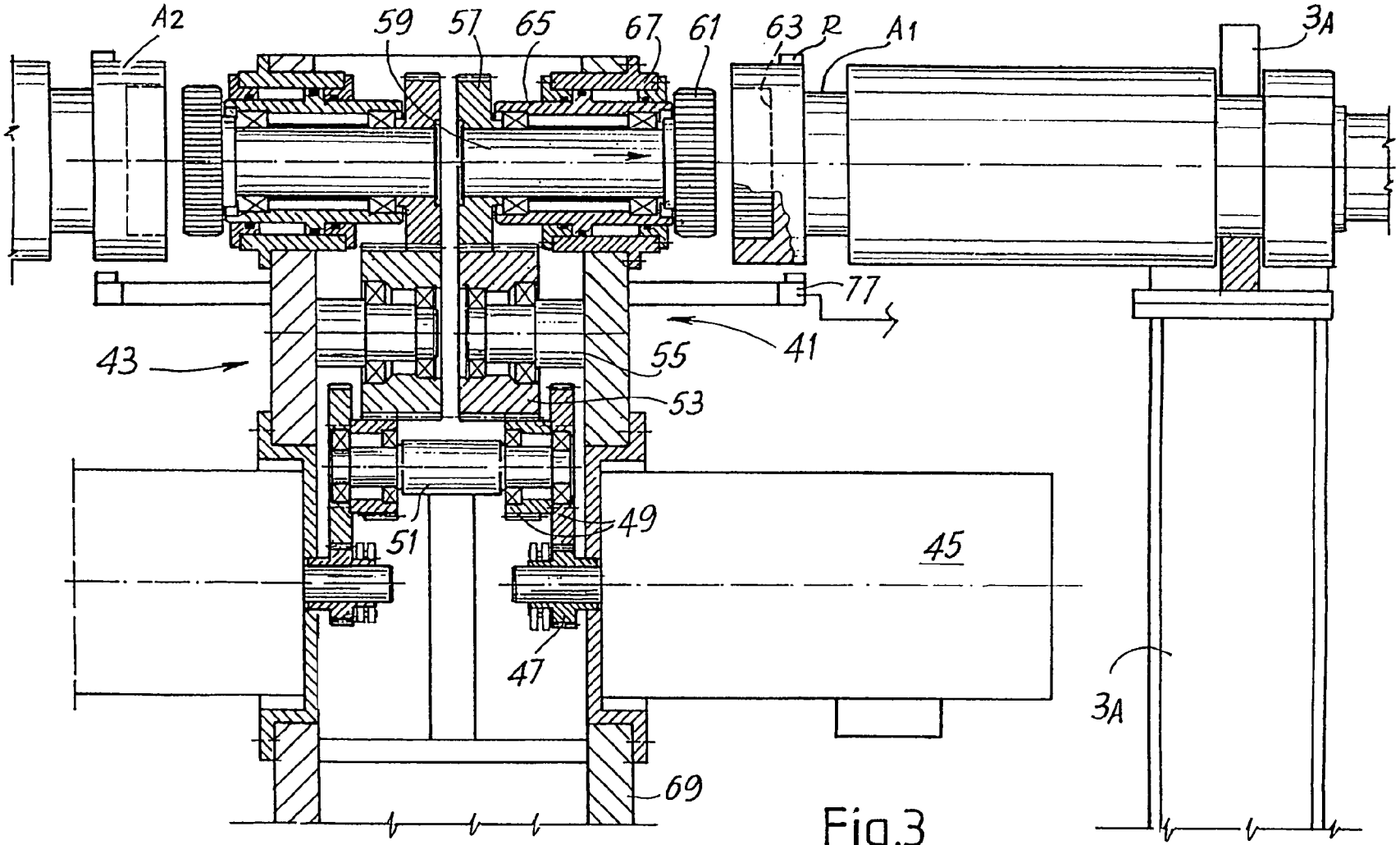
FIG. 3 shows an enlarged section of the center drive mechanism.

A central zone of the carriage 1 between the side supports 5B and 3A of the reels B1 and B2 is provided, for each reel, with a center drive mechanism, designed to apply an unwinding torque on the shaft of the reel momentarily in the delivery position (reel B1 in the layout in FIG. 1). The center drive mechanisms; indicatively represented in FIG. 2 and shown in greater detail in FIG. 3, are specular with each other and only the center drive mechanism associated with the supports 3A, 5A for the reel B1 will be described hereafter. The center drive mechanisms are indicated as a whole with 41 and 43.

With reference to FIG. 3, the center drive mechanism 41 comprises a variable speed motor 45, for example a brushless motor or a vector motor. This transmits movement, by means of a pinion 47 splined on its motor shaft, to a pair of gears 49 integral with each other, supported idle on a central shaft 51, common to the two center drive mechanisms 41, 43. The second gear 49 meshes with a further gear 53, mounted idle on a fixed spindle 55, which in turn transmits motion to a crown gear 57 splined on a shaft 59 frontally provided with toothing 61 forming part of a corresponding grooved coupling and designed to engage in a corresponding groove 63, frontally machined in the shaft A1 of the reel B1.

The shaft 59 is supported idle inside a sleeve 65 which slides axially in a tubular element 67 rigidly connected to an upright 69 which also supports the motor 45 and the spindle 55. On the outside of the sleeve 65 there is a ring with respective seals on the internal cylindrical surface of the tubular element 67. The sleeve 65 thus forms a piston that slides inside a cylinder composed of the tubular element 67 and the two elements together form a piston-cylinder actuator which commands coupling and decoupling movement of the grooved coupling between shaft 59 and shaft A1 of the reel.

The center drive mechanism 41 or 43 may thus be released from the respective reel, allowing the used up reel to be replaced with a new reel. Moreover, it may be connected to the shaft of the reel and used to make the reel also rotate in the side standby position (reel B2 in FIG. 2) to position the initial edge of the web material N. In the unwinding position (reel B1) the shaft 59 is coupled on the shaft A1 of the reel to apply a torque to the center of the reel; this torque, in combination with the torque applied by the peripheral drive mechanism 13 draws and maintains the reel in rotation during unwinding of the web material.

The device is also equipped with a control unit schematically indicated in FIG. 1 and marked therein with 71. The central unit is connected to the two motors 45 of the center drive mechanisms 41 and 43 and to the motor 23 of the peripheral drive mechanism 13. Moreover, some sensors or other detection means are interfaced with the central unit 71, to supply a series of information, as specified below. Some of these sensors may be omitted depending on the type of control method used, as will be specified in greater detail below.

These sensors or detection means include a sensor 73 mounted on the structure 11 to detect the diameter of the reel B1 in the unwinding position. The sensor 73 may be a laser, infrared, ultrasound or other sensor suitable for the purpose. A sensor 75 is mounted on the arm 21 to read markings printed on the edge of the reel B1 or B2 in the unwinding position. These markings are applied for example by tracing a straight line on the flat face of the reel with a felt tip pen or in another manner. In FIG. 1 the marking is indicated with M. The sensor 75 may, for example, be an optic sensor. The marking M does not damage the material, as in any case the edge of the material is destined to be removed from the finished product. Alternatively, marking invisible to the naked eye may be used, for example which absorbs in the field of UV radiation. The sensor 75 will correspondingly operate in the same range of frequencies.

Another sensor 77 is associated with each of the supports of the reels B1 and B2 and is used to read a reference integral with the shaft A1 or A2 of the reel in the unwinding position. In FIG. 3 the reference is indicated with R. The reference R may for example be a magnet and the sensor 77 an electromagnetic sensor, or a capacitive sensor or even an optic sensor may be used. The reference R will consequently be designed according to the type of sensor and so that it can be detected by the sensor.

A load cell or other transducer may be associated with the transmission cylinder 9 of the web material, to detect the tension in the material. The load cell or other transducer may also be associated with a different transmission mechanism of the web material.

Finally, the central unit 71 may be interfaced with a control unit associated with other machines of the line, downstream of the unwinding device, which receive the web material N.

With these mechanisms and sensors, the device described may operate as follows.

A new reel B1 is inserted in the unwinding position (reel B1 in FIG. 1) and the leading edge of the web material N is joined to a tail edge of material unwound from the previous reel. At this point the reel B1 must be made to rotate and kept rotating at a suitable speed to feed the converting line for which the web material N is destined, keeping it at the tension required by the line downstream. For this purpose, according to the preferred embodiment of the invention, the central unit 71 receives (for example from the central control unit of a rewinding machine downstream of the unwinding machine) information relative to the speed at which the web material N must be fed and if necessary relative to the acceleration ramp to which the reel must be subjected. This speed coincides with the speed that the peripheral drive mechanism 13 must give the periphery of the reel. The diameter of the reel is detected by the sensor 73 and the angular speed at which the center drive mechanism 41 must draw the shaft A1 of the reel in rotation is consequently calculated.

After this calculation, the device may start up and the two driven mechanisms, the peripheral mechanism 13 and the center mechanism 41 respectively, are operated at the calculated speed.

Through the tension sensor, for example the load cell on the cylinder 9, the tension of the web material is detected and if necessary the central unit 71 consequently controls the speed of the belts 15 of the peripheral drive mechanism 13. If the detected tension is too high the speed of the peripheral drive mechanism is increased and vice versa. Consequently, on the basis of the measurement of the diameter obtained with the sensor 73 the angular speed of the drive mechanism 41 is also corrected.

To guarantee that both drive mechanisms take action on the reel B1 in a correct and combined manner, with adequate distribution of torques, and without the external turns of the reel tending to slip in relation to the internal turns and consequently in relation to the central shaft A1 of the reel (which may occur for example for very large and heavy reels or if the turns are wound slackly), a feedback system is provided.

In a first possible control mode, the central unit 71 detects a datum relative to the torque applied from the motors 23 and 45. If the peripheral drive mechanism 13 is (as preferable) the main mechanism or "master", and the center drive mechanism 41 is the subordinate mechanism or "slave", the unit 71 will produce a possible feedback signal when the torque applied by the center drive mechanism differs from a range of preset values, to re-balance the system. For example, if the torque applied by the center drive mechanism 41 tends to decrease below the set value, this means that the center drive mechanism tends to be drawn by the reel, rather than applying a driving torque to it. The feedback signal will cause positive acceleration of the center drive mechanism. On the other hand, if the torque applied by the center drive mechanism 41 tends to rise above a preset limit, this means that the drive mechanism 41 tends to prevail over the peripheral drive mechanism 13 and the feedback signal will consequently tend to reduce its angular speed. When this operating mode is adopted, the sensors 75 and 77 are not active or might even be missing.

In a different operating mode, using the sensors 75, 77, the center drive mechanism is controlled by a feedback signal produced on the basis of the readings of the two sensors 75, 77. In normal operating conditions, the angular distance between each of the markings M on the various turns of the material N and the reference R is fixed. If the outermost turn(s) of the web material tend(s) to slip on the turns below, there will be a variation in the angular distance between the marking read by the sensor 75 and the reference read by the sensor 77. The variation in the angular distance has a sign and may be positive or negative according to the tendency of the outermost turn to tighten or loosen in relation to the innermost web material. The relative feedback signal produced by this variation in the angular distance will tend to cancel slippage. Therefore, if the variation in angular distance corresponds to a tendency of the outermost turn to become tighter over the material below, this means that the shaft of the reel must be accelerated and consequently the angular speed of the center drive mechanism 41 will be increased. The opposite will occur if the outermost turn of web material tends to slacken. Indeed, in the first case the feedback signal will indicate that the outermost turn or portion of outermost turn of the material tends to "run faster" than the shaft of the reel and than the innermost zone of the reel and that the shaft must therefore be accelerated. In the second case the feedback signal will indicate the opposite situation: the outermost turn(s) of the web material tend(s) to slow down in relation to the core of the reel, which tends to run faster than the periphery.

The feedback signal may merely arrest the variation in the angular distance or may restore the angular distance to the original value, so as to avoid accumulation of reciprocal slippage between the turns of web material. In general, this is referred to in both cases as correction of the offset.

It is understood that the drawing only shows a possible embodiment of the invention, which may be varied in its forms and dispositions without however departing from the scope of the underlying concept of the invention. Any presence of reference numbers in the attached claims has the sole: purpose of facilitating the reading of the claims with reference to the description above and to the attached drawings, and does not limit the scope of protection represented by the claims.

The invention claimed is:

1. An unwinding device for unwinding reels of web material wound around a central shaft and delivering said web material to a converting line, comprising:

supports to support at least a reel in an unwinding position;

at least a peripheral drive mechanism which acts on a cylindrical surface of the reel being unwound and peripherally transmits to said reel a torque to draw the reel in rotation;

at least a center drive mechanism which transmits centrally to said reel an auxiliary torque to draw the reel in rotation in combination with the torque transmitted by said peripheral drive mechanism;

a control system to reciprocally coordinate operation of said peripheral drive mechanism and of said center drive mechanism; and a detection system to detect, during unwinding, angular displacement of an outermost web material on the reel in relation to the central shaft of the reel, operation of said center drive mechanism being controlled so as to correct said angular displacement.

2. Device according to claim 1, wherein said control system controls at least an operating parameter of the center drive mechanism as a function of unwinding conditions.

3. Device according to claim 2, wherein said control system controls speed of the center drive mechanism.

4. Device according to claim 3, wherein said control system acts on the speed of the center drive mechanism to correct said angular displacement.

5. Device according to claim 2, wherein said control system controls the auxiliary torque applied by said center drive mechanism.

6. Device according to claim 5, wherein said control system is programmed to maintain the auxiliary torque applied by said center drive mechanism within a predetermined interval of values or at a predetermined value.

7. Device according to claim 1, wherein speed of said peripheral drive mechanism is controlled so as to maintain a set value of tension of the web material delivered by said reel, a tensioning sensor being associated with said control system.

8. Device according to claim 1, further comprising a first sensor to detect at least a first reference integral with the central shaft of said reel; and a second sensor to detect at least a second reference applied to the web material of the reel.

9. Device according to claim 8, wherein said second sensor is carried by a supporting arm of the peripheral drive mechanism.

10. Device according to claim 1, further comprising a sensor to detect a diameter of said reel, associated with said control system.

11. Device according to claim 10, wherein said control system is programmed to control the center drive mechanism giving the center drive mechanism an angular rotation speed determined as a function of speed of the peripheral drive mechanism and of the diameter of the reel.

12. Device according to claim 11, wherein said control system is programmed to produce a feedback signal on said center drive mechanism, said feedback signal modifying operation of the center drive mechanism as a function of unwinding conditions.

13. Device according to claim 12, wherein said feedback signal is a function of said angular displacement.

14. Device according to claim 12, wherein said feedback signal is a function of a value of the auxiliary torque applied to the reel by said center drive mechanism.

15. Device according to claim 1, wherein said peripheral drive mechanism comprises a belt and means which press said belt on a cylindrical external surface of the reel being unwound.

16. Device according to claim 1, wherein said center drive mechanism comprises a shaft equipped with coupling means engageable and disengageable in relation to the central shaft of the reel.

17. Device according to claim 16, wherein said coupling means comprise a grooved coupling.

18. Device according to claim 16, wherein said shaft is axially mobile to engage and disengage from the central shaft of the reel.

19. Device according to claim 18, wherein said shaft is supported in a sleeve which slides axially inside a tubular element, said tubular element constituting a cylinder of a piston-cylinder actuator, of which said sleeve forms a moving piston.

20. Device according to claim 19, further comprising a first gear splined on said shaft, meshing with a second gear toothing of which has an axial length sufficient to maintain the first gear and the second gear in contact in any axial position of the shaft.

21. Device according to claim 1, wherein said supports include dual central end supports for at least two approximately axially aligned reels, with the center drive mechanism for one and for another of said reels being disposed between the dual central end supports for the two reels.

22. Device according to claim 1, wherein said control system is programmed to disconnect one or another of the peripheral drive mechanism and the center drive mechanism.

* * * * *